US006422504B1

(12) United States Patent
Elder

(10) Patent No.: US 6,422,504 B1
(45) Date of Patent: Jul. 23, 2002

(54) WIRE SPOOL CART

(76) Inventor: Doyle W. Elder, P.O. Box 278, Arapaho, OK (US) 73620

( * ) Notice: Subject to any disclaimer, the term of this patent is extended or adjusted under 35 U.S.C. 154(b) by 0 days.

(21) Appl. No.: 09/660,179

(22) Filed: Sep. 12, 2000

Related U.S. Application Data

(63) Continuation-in-part of application No. 09/296,419, filed on Apr. 23, 1999, now Pat. No. 6,116,533.

(51) Int. Cl.[7] ..... B65H 49/38; B65H 16/02; B62B 1/18

(52) U.S. Cl. ..... 242/594.6; 242/557; 242/566; 242/588.2; 242/594.4; 211/85.5; 280/79.3

(58) Field of Search ..... 242/557, 594.4, 242/594.6, 566, 129, 588.2; 211/85.5, 59.1; 280/79.3

(56) References Cited

U.S. PATENT DOCUMENTS

| | | | | | |
|---|---|---|---|---|---|
| D182,483 | S | * | 4/1958 | Skinner | 280/79.3 X |
| 3,856,230 | A | * | 12/1974 | Zimmer | 242/557 X |
| 4,533,091 | A | | 8/1985 | Knight et al. | |
| 5,188,308 | A | | 2/1993 | Tussing | |
| 5,275,349 | A | | 1/1994 | Tussing | |
| 5,285,981 | A | | 2/1994 | Pavelka | |
| 5,316,232 | A | * | 5/1994 | Lambert, Jr. | 242/557 X |
| 5,687,928 | A | * | 11/1997 | Lassiter | 242/557 |
| 6,065,714 | A | * | 5/2000 | Fondacaro | 242/557 |
| 6,116,533 | A | * | 9/2000 | Elder | 242/594.4 |
| 6,182,920 | B1 | * | 2/2001 | Watkins | 242/594.4 |
| 6,270,094 | B1 | * | 8/2001 | Campbell | 280/79.3 X |

FOREIGN PATENT DOCUMENTS

| | | | | |
|---|---|---|---|---|
| DE | 36 04 657 A1 | * | 8/1987 | 280/79.3 X |

* cited by examiner

*Primary Examiner*—Michael R. Mansen
*Assistant Examiner*—Minh-Chau Pham
(74) *Attorney, Agent, or Firm*—Siemens Patent Services, LC

(57) ABSTRACT

In the wiring industry is often necessary to either run a number of individual wires together as a bundle or to use a variety of different types of wire on a regular basis. In either case it is cumbersome to have to handle a number of individual spools of wire while working on an installation. Therefore, the present invention presents an easily maneuvered, four wheeled cart upon which a number of spools of wire, or other spooled material, of either like size or different sizes, can be rotatably mounted along inclined plane such that wires can be pulled from multiple spools without becoming entangled one with another. A wire guide aids in bringing the various wires together as a bundle for pulling as a single unit.

4 Claims, 1 Drawing Sheet

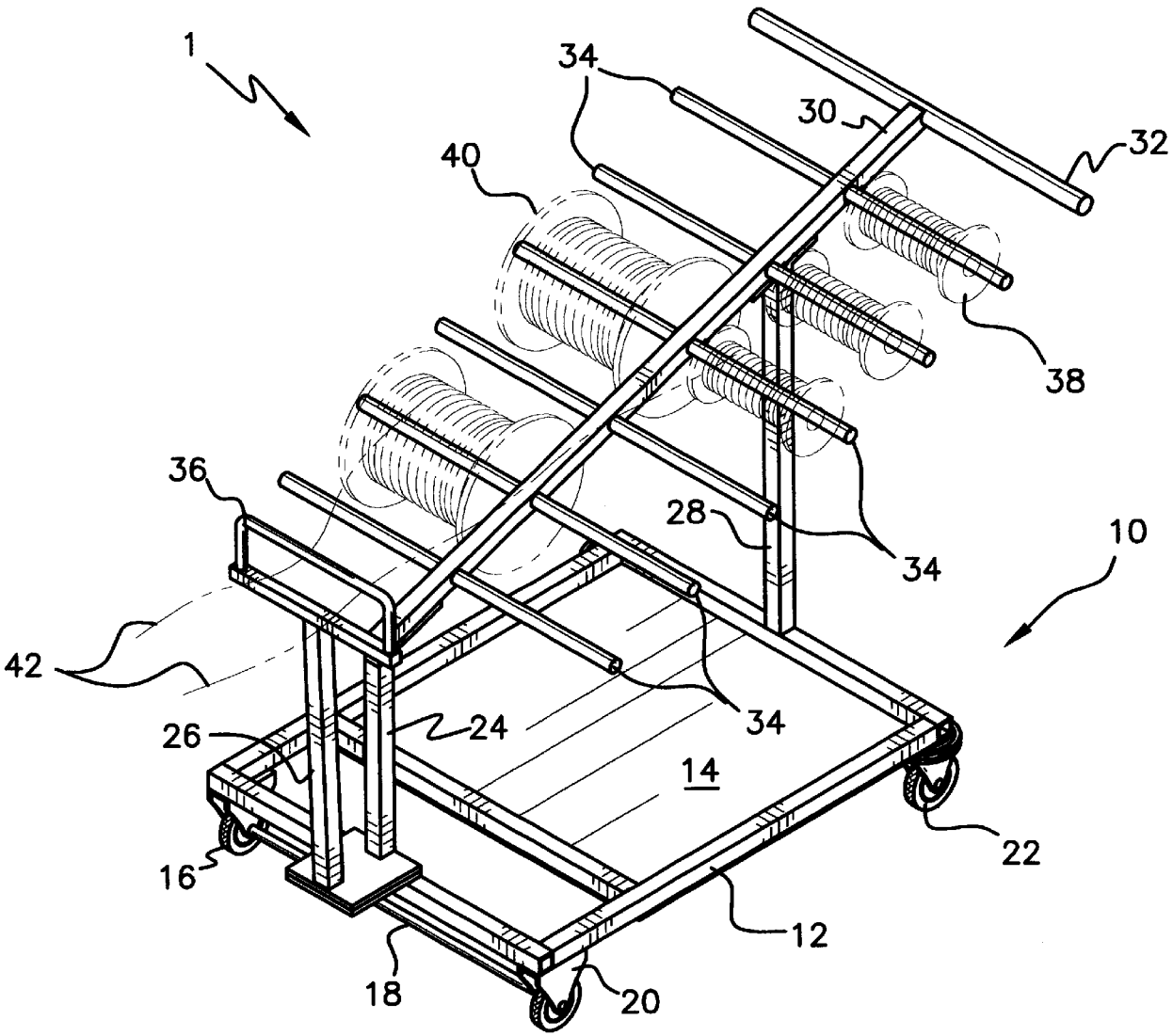
32
38
10
22
34
30
12
34
28
14
34
20
40
24
18
1
36
26
16
42

WIRE SPOOL CART

This application is a Continuation-In-Part of Ser. No. 09/296,419, filed Apr. 23, 1999 now U.S. Pat. No. 6,116, 533.

BACKGROUND OF THE INVENTION

1. Field of the Invention

The present invention relates to the wiring installation industry, as it might relate to electrical, telephone, fiber optics or any other area where a plurality of wires are run together or where a variety of different types of wire are used on the same job site. More particularly, the invention comprises a cart upon which a plurality of spools of wire, either of the same or different types, can be placed in order to facilitate the easy storage, movement and installation of the wire.

2. Description of the Prior Art

U.S. Pat. No. 5,316,232, issued to John A. Lambert, Jr. on May 31, 1994 presents a OMNIDIRECTIONAL WIRE DISPENSER from which wire may be dispensed from a plurality of spools simultaneously. Lambert discloses a horizontal framework mounted with wheels at a first end and an extendable handle extending at a second end, the handle extending from a central shaft running from the first end to the second end. Mounted horizontally and orthogonal to the central shaft are a plurality of spool holders, each designed to hold a single spool of wire, and tensioning bars to exert tension on the spools as wire is played out. Spools are retained on the spool holders by retaining clips at the end of each bar. A grid in the top of the framework forms wire guide windows such that the wire from each individual spool exits the framework separately and can be pulled in any direction, either individually or jointly with other wires. Having wheels at only one end, Lambert requires a degree of lifting for movement, while the present invention is mounted on four wheels for easy mobility. The present invention also provides the added convenience of a storage surface which Lambert does not have.

U.S. Pat. No. 5,285,981, issued to Steven M. Pavelka on Feb. 15, 1994 presents a WIRE DISPENSER from which wire may again be dispensed from a plurality of spools simultaneously. Pavelka discloses a central rectangular frame having an axle mounted perpendicularly to the lower end of a first, or rear, of the longer members and a horizontal front stabilizing bar mounted perpendicularly to the lower end of the second, or front, of the longer members. Parallel to the axle and stabilizing bar are a plurality of spool bars mounted to both of the longer members of the frame. Spools are retained on the spool bars by retaining clips at the end of each bar. Again, Pavelka requires a degree of lifting for movement, due to the two wheel configuration, while the present invention is mounted on four wheels for easy mobility. And again, the present invention also provides the added convenience of a storage surface which Pavelka does not have.

U.S. Pat. No. 5,275,349, issued to Norman P. Tussing on Jan. 4, 1994, presents a CART FOR SPOOLS OF WIRE from which wire may again be dispensed from a plurality of spools simultaneously. Tussing discloses a "T" shaped tricycle frame with the single wheel having a pivoting motion. Mounted vertically above the single wheel is a handle terminating in an eye at it uppermost end. Mounted at the juncture of the leg and the cross arm of the "T" of the frame is a spool support assembly, being basically vertical, having a plurality of spool bars mounted horizontally thereto, parallel with the cross arm of the "T" of the frame. At the top of the spool support assembly, level with the eye of the handle, is a sleeve for receiving a mandrel, running from the eye of the handle, for supporting a large diameter spool of wire. Wires from the plurality of spools mounted on the cart may also be run through the eye when being pulled as a bundle. Tussing provides for ease of mobility through a three wheel cart, but still does not provide the added convenience of a storage surface.

U.S. Pat. No. 5,188,308, issued to Norman P. Tussing on Feb. 23, 1993 presents a WIRE CART FOR OPTIONAL USE AS A CONDUIT CART from which wire may be dispensed from a plurality of spools simultaneously, upon which electrical conduit may be carried, or a combination of the two. Tussling here discloses a cart composed of a central, longitudinal frame member with a cross frame member at each end, supported by wheels at each of the four corners of the cart. Vertical post assemblies are mounted at the junction of the longitudinal frame member and each of the cross members, each vertical post assembly supporting a number of basically horizontal spool/conduit supports parallel to the cross members of the frame. Removable vertical post assemblies may be mounted along the central, longitudinal frame member for additional spool/conduit supports, as needed. Additionally, each vertical post has at it uppermost limit a sleeve for receiving a bar running longitudinally of the cart for supporting larger spools. Tussing provides for ease of mobility through a four wheel cart, but still does not provide the added convenience of a storage surface or easy steerability of a separate handle.

U.S. Pat. No. 4,533,091, issued to Reed H. Knight, et. al., on Aug. 6, 1985 presents a PORTABLE MULTIPLE SPOOL WIRE DISPENSER a mounting bracket which can be mounted on the rear legs of a step ladder to receive a rod for holding several small spools of wire. While useful for relatively small wiring installation, Knight does not provide the flexibility for large numbers of spools or large sized spools, nor does it provide the storage capacity of the present invention.

None of the above inventions and patents, taken either singly or in combination, is seen to describe the instant invention as claimed.

SUMMARY OF THE INVENTION

In the wiring industry is often necessary to either run a number of individual wires together as a bundle or to use a variety of different types of wire on a regular basis. In either case it is cumbersome to have to handle a number of individual spools of wire while working on an installation.

Accordingly, it is a principal object of the invention to provide a cart upon which a number of spools of wire can be stored easily.

It is another object of the invention to provide a cart upon which a number of spools of wire can be transported easily.

It is a further object of the invention to provide a cart from which a number of spools of wire can be installed easily, either as a bundle of different wires or as different individual wires.

Still another object of the invention is to provide a cart with which it is easy to navigate about an installation site.

An additional object of the invention is to provide a cart which can be used by a single individual.

It is again an object of the invention to provide a cart which can accommodate spools of different sizes.

Yet another object of the invention is to provide a cart which is economical to produce.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

The sole FIGURE is an environmental perspective of the invention, with wire spools installed in phantom.

DETAILED DESCRIPTION OF THE PREFERRED EMBODIMENTS

Cart 1 has a base 10, having a generally rectangular frame 12 and storage tray 14. Frame 12 is mounted with a pair of wheels 16 mounted by axle 18 and flanges 20 proximate its front corners and swivelling caster style wheels 22 proximate its rear corners. Front post 24 is mounted normal to base 10, centered along the front edge of frame 12, adjacent to and behind wire guide post 26, which has a slight deviation from normal toward the front of frame 12. Rear post 28 is mounted normal to base 10 centered along the rear edge of frame 12. Spool rod support 30 is mounted at one end to the top of front post 24, extending beyond and resting atop rear post 28, terminating at its second end in handle bars 32. Mounted horizontally and orthogonal to spool rod support 30 are a plurality of evenly spaced spool rods 34. Mounted at the top of wire guide post 26 is wire guide 36, a rectangular frame, open at its center, allowing wire 42 from spools 38 and 40 mounted on the various spool rods 34 to be brought together as a bundle to be directed for pulling as a unit.

The respective heights of rear post 28, front post 24 and wire guide post 26 are such that handle bars 32 are at a height between the waist and chest of an average adult and wire 42 from each spool 38 or 40 mounted along spool rod support 30 can be run to wire guide 36 without interference from wire 42 from the next lower spool 38 or 40 when the wire 42 is run from each spool 38 or 40 in an over the top fashion.

Spool rods 34 are sized and spaced such that two smaller spools 38 can be placed on each spool rod 34 on both the right and left side of spool rod support 30. Alternatively, one larger spool 40 could be placed on the every second spool rod 34, with the intervening spool rods 34 being left empty. Smaller spools 38 and larger spools 40 could also be installed together in a number of different configurations. Tray 14 could be used to store additional spools 38 or 40 of wire 42 or other items, such as tools.

It would be evident to one skilled in the art that the present invention could be produced in a variety of sizes to accommodate large, intermediate and small applications.

It would likewise be evident to one skilled in the art that the present invention could be produced from a variety of materials, although aluminum or light weight steel would probably be preferable.

It would be further evident to one skilled in the art that spool rods 34 could be of varying diameter or have sleeves fit over them to accommodate different diameters of spool cores.

It would be even further evident to one skilled in the art that spool rods 34 could have a retaining clip of any variety at their ends to hold spools 38 or 40 in place.

It is to be understood that the present invention is not limited to the embodiments described above, but encompasses any and all embodiments within the scope of the following claims.

What is claimed is:

1. A wire spool cart comprising, a rectangular base frame, having
a front,
a rear, and
a right and left side, a pair of non-swivelling wheels proximate the front corners of said base frame, a pair of swivelling, caster type wheels proximate the rear corners of said base frame, a front post centered upon the front member of said base frame and rigidly mounted normal thereto, a rear post centered upon the rear member of said frame and rigidly mounted normal thereto, a spool rod support rigidly mounted at one end to the top of said front post, extending rearwardly and being rigidly mounted at a second end to the top of said rear post, said front post being of a lesser height than said rear post such that said spool rod support slopes upwardly from the front of said cart to the rear of said cart, said spool rod support having a plurality of spool rods rigidly mounted horizontally and orthogonal to said spool rod support, a wire guide post rigidly mounted, angled with a minor forward sloping deviation from normal to said base frame in front of said front post, and a wire guide, having a vertical rectangular frame, forming one central opening, is rigidly mounted to the top of said wire guide post such that said wire guide is situated slightly in front of and above the lowest of said spool rods, allowing wire from spools mounted on the various of said spool rods to be brought together as a bundle to be directed for pulling as a unit.

2. A wire spool cart, as defined in claim 1, wherein said base frame has mounted within a longitudinal plane created by the frame thereof
a storage shelf.

3. A wire spool cart, as defined in claim 1, wherein said spool rod support extends rearwardly, beyond said rear post, terminating in a handlebar, rigidly mounted horizontally and extending orthogonally from said spool rod support, said handlebar being attached at the center point of said handlebar; and said handlebar, in conjunction with said swivelling wheels, adapted for steerage of the wire spool cart from behind said wire spool cart.

4. A wire spool cart comprising, a rectangular base frame, having
a front,
a rear, and
a right and left side, a pair of non-swivelling wheels proximate the front corners of said base frame, a pair of swivelling, caster style wheels proximate the rear corners of said base frame, a front post centered upon the front member of said base frame and rigidly mounted normal thereto, and a rear post centered upon the rear member of said frame and mounted normal thereto, said rear post being of greater height than said front post, a spool rod support rigidly mounted at one end to the top of said front post, rigidly mounted at an intermediate point to the top of said rear post, and extending rearwardly from said rear post, terminating at a second end with a handlebar, rigidly mounted horizontally and orthogonally at said second end of said spool support rod and at the center point of said handlebar, and said handlebar, in conjunction with said swivelling wheels, adapted for steerage of the wire spool cart from behind said wire spool cart, and said spool support rod further having a plurality of spool rods, said plurality of spool rods are rigidly mounted horizontally and orthogonal from said spool rod support, a wire guide post rigidly mounted at an angle in front of said front post with a minor forward sloping deviation from normal to said base frame and having rigidly mounted at the top thereof a wire guide, having a vertical rectangular frame, open at the center thereof, such that said wire guide is situated slightly in front of and above the lowest of said spool rods, allowing wire from spools mounted on the various of said spool rods to be brought together as a bundle to be directed for pulling as a unit, and a storage shelf mounted within a longitudinal plane created by said base frame.

* * * * *